US005310186A

United States Patent [19]

Karsten

[11] Patent Number: 5,310,186

[45] Date of Patent: May 10, 1994

[54] GOLF CLUB HEAD WITH WEIGHT PAD

[75] Inventor: Solheim Karsten, Phoenix, Ariz.

[73] Assignee: Karsten Manufacturing Corporation, Phoenix, Ariz.

[21] Appl. No.: 32,304

[22] Filed: Mar. 17, 1993

[51] Int. Cl.[5] ..... A63B 53/04

[52] U.S. Cl. ..... 273/171; 273/167 H

[58] Field of Search ..... 273/77 R, 167 R, 167 A, 273/167 F, 167 G, 167 H, 167 J, 170, 171, 172, 173, 174, 175, 193 R, 194 R, 194 B, 80 C, 169, 162 R, 164.1

[56] References Cited

U.S. PATENT DOCUMENTS

| | | | |
|---|---|---|---|
| 1,133,129 | 3/1915 | Govan | 273/171 |
| 1,167,206 | 1/1916 | Palmer . | |
| 1,526,438 | 7/1923 | Scott . | |
| 1,582,836 | 7/1925 | Link . | |
| 1,666,174 | 4/1928 | Holland | 273/169 X |
| 2,067,556 | 1/1937 | Wettlaufer | 273/171 X |
| 2,087,685 | 7/1937 | Hackney | 273/167 F |
| 2,395,837 | 3/1946 | Baymiller | 273/175 |
| 2,708,579 | 5/1955 | Hagman | 273/167 F X |
| 3,941,390 | 3/1976 | Hussey | 273/167 F X |
| 3,966,210 | 6/1976 | Rozmus | 273/169 |
| 4,010,958 | 3/1977 | Long | 273/167 G X |
| 4,021,047 | 5/1977 | Mader | 273/167 H |
| 4,313,607 | 2/1987 | Thompson | 273/167 A |
| 4,322,083 | 3/1982 | Imai | 273/167 F |
| 4,432,549 | 2/1984 | Zebelean | 273/167 H |
| 4,489,945 | 12/1984 | Kobayashi | 273/167 H |
| 4,511,145 | 4/1985 | Schmidt | 273/167 H |
| 4,725,062 | 2/1988 | Kinney | 273/175 |
| 4,754,969 | 7/1988 | Kobayashi | 273/77 A |
| 4,867,458 | 9/1989 | Sumikawa | 273/171 |
| 4,869,507 | 9/1989 | Sahm | 273/171 |
| 4,890,840 | 1/1990 | Kobayashi | 273/167 H |
| 5,028,049 | 7/1991 | McKeighen | 273/167 H |
| 5,056,705 | 10/1991 | Wakita et al. | 228/176 |
| 5,058,895 | 10/1991 | Igarashi | 273/167 F |
| 5,141,230 | 8/1992 | Antonious | 273/167 H |
| 5,193,811 | 3/1993 | Okumoto | 273/167 F |

FOREIGN PATENT DOCUMENTS

| | | | |
|---|---|---|---|
| 211781 | 12/1957 | Australia | 273/167 F |
| 8801525 | 3/1988 | World Int. Prop. O. | 273/167 F |

*Primary Examiner*—Vincent Millin
*Assistant Examiner*—Sebastiano Passaniti
*Attorney, Agent, or Firm*—Herbert E. Haynes, Jr.; Darrell F. Marquette

[57] ABSTRACT

A golf club head made of a suitable metal such as stainless steel includes a hollow body and a hosel. The hollow body has a top wall, a bottom wall, a side wall, and a front wall with a face arranged for impacting golf balls. The hollow body has a weight pad which provides the golf club head with increased resistance to rotation or twisting upon impact with golf balls at off-center points on the face. The weight pad weighs between 5 and 15 grams and is located in the heel portion of the body. The weight pad is elongated in a direction extending along a length dimension of the body side wall.

6 Claims, 1 Drawing Sheet

GOLF CLUB HEAD WITH WEIGHT PAD

BACKGROUND OF THE INVENTION

This invention relates generally to golf clubs and, in particular, to a golf club head with a weight pad for increasing resistance to rotation or twisting of the golf club head on off-center impacts with golf balls.

Golf clubs known as "woods" traditionally have a head made of a suitable wooden material such as maple or persimmon attached to one end of an elongated shaft. These wooden club heads are usually solid and are shaped with their weight properly distributed about their center of gravity to maximize performance. Golf club "wood" heads have also been formed of suitable metals such as stainless steel. Metal heads are usually hollow. Various attempts have been made to distribute weight in metal heads with respect to their center of gravity so that performance is maximized. Such attempts have included placing different types and numbers of weight members at different locations inside the metal heads. Examples of such attempts are disclosed in prior U.S. Pat. Nos. 1,167,106 to Palmer; 1,526,438 to Scott; 1,582,836 to Link; 5,058,895 to Igarashi; and 5,141,230 to Antonious. In the Palmer, Scott and Link patents, weight members are located directly behind the center of gravity of the club head. In the Igarashi and Antonious patents, weight members are located in heel and toe portions of the club heads.

SUMMARY OF THE INVENTION

The present invention provides a golf club head having a center of gravity. The golf club head includes a hollow body having a heel portion, a toe portion, a top wall, a bottom wall, a side wall between the top and bottom walls, a front wall with a face arranged for impacting a golf ball. The golf club head also includes a hosel for receiving one end of an elongated shaft. The face has a sweet spot thereon aligned with the center of gravity so that when a golf ball is impacted at the sweet spot no rotation of the club head will occur. The face is disposed forwardly of and inclined with respect to a first vertical plane containing a longitudinal axis of the elongated shaft, and the face intersects and is substantially perpendicular to a second vertical plane containing the center of gravity. The second vertical plane divides the body into the heel and toe portions. A weight pad is disposed along the side wall in the heel portion of the body rearwardly of the first vertical plane and intermediate the hosel and the second vertical plane. The weight pad provides the golf club head with increased resistance to horizontal rotation about a vertical axis that extends through the center of gravity when the club head impacts a golf ball on the face at off-center points spaced laterally of the sweet spot.

In the preferred embodiment of the golf club head, the body side wall has a length dimension measured between the first vertical plane and a third vertical plane which is disposed generally parallel to the first vertical plane while being located rearwardly of both the front wall and the hosel, and the weight pad has an elongate shape in a direction extending along the length dimension of the side wall. The weight pad weighs between 5 and 15 grams. The weight pad is divided into two substantially equal parts by a fourth vertical plane which intersects the first and second vertical planes at approximately 45 degrees. The first, second and fourth vertical planes intersect at a common axis.

DESCRIPTION OF THE PREFERRED EMBODIMENT

Figure 1:
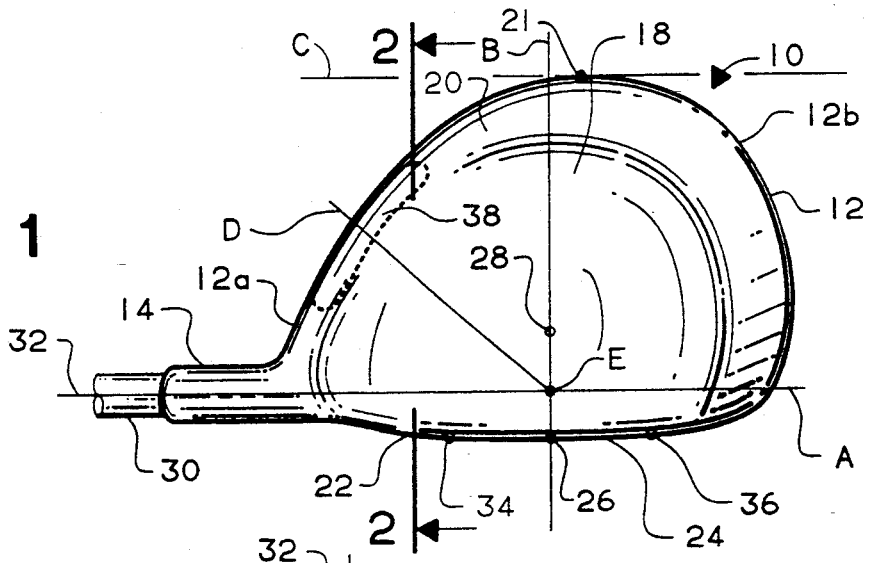
FIG. 1 is a bottom view of a golf club head having a weight pad according to the present invention.

Referring to FIG. 1, a golf club head 10 includes a hollow body 12 and a hosel 14 preferably formed of a suitable metal such as stainless steel. The body 12 has a heel portion 12*a*, a toe portion 12*b*, a top wall 16, a bottom wall 18, a side wall 20 between the top and bottom walls 16 and 18, and a front wall 22 having a face 24 arranged for contacting a golf ball. Located on the face 24 is a generally central point 26 known as a "sweet spot" which is aligned with a club head center of gravity 28. When the face 24 impacts a golf ball at the sweet spot 26, no rotation or twisting of the club head 10 will occur. One end of an elongated shaft 30 is received in the hosel 14.

The club head face 24 is disposed forwardly of and inclined with respect to a first vertical plane A which contains the longitudinal axis 32 of the shaft 30. The face 24 intersects and is substantially perpendicular to a second vertical plane B which contains the sweet spot 26 and the center of gravity 28. The vertical plane B divides the body 12 into the heel and toe portions 12*a*, 12*b*. The side wall 20 of the body 12 has a length dimension measured between the first vertical plane A and a third vertical plane C which is generally parallel to the vertical plane A while being located rearwardly of both the hosel 14 and the front wall 22. The vertical plane C contains a rearwardmost point 21 on the side wall 20.

The body 12 has a generally teardrop shape with a large percentage of its weight located in the toe portion 12*b* thereof and a small percentage of its weight located in the heel portion 12*a* thereof. The teardrop shape of the body 12 makes the club head 10 very aerodynamic on a golfer's downswing. Upon impact with a golf ball at any off-center points (such as points 34, 36) on the face 24 spaced laterally of the sweet spot 26, the extra weight in the body toe portion 12*b* increases horizontal rotation or twisting of the club head 10 (in either a clockwise direction or in a counterclockwise direction when viewed in FIG. 1) about a vertical axis that extends through the center of gravity 28. For example, upon impact at the off-center point 34, the horizontal club head rotation causes the face 24 to close which results in a fade type spin on the golf ball. Upon impact at the off-center point 36, the horizontal club head rotation or twisting causes the face 24 to open which results in a hook type spin on the golf ball.

It has been determined that a properly located weight member will provide the golf club head 10 with increased resistance to horizontal rotation or twisting upon off-center impacts with golf balls. This increased resistance to horizontal rotation or twisting of the club head 10 results in less fade type spin and less hook type spin on golf balls which are impacted at off-center points on the face 24. Accordingly, a weight pad 38 is formed generally along the inside of the body side wall 20 in the heel portion 12*a* of the body 12. The weight pad 38 is located rearwardly of the first vertical plane A and intermediate the hosel 14 and the second vertical plane B. The weight pad 38, which preferably weighs between 5 and 15 grams, is arranged so that it is divided into two substantially equal parts by a fourth vertical plane D that intersects the vertical planes A and B at approximately 45 degrees. The first, second and fourth vertical planes A, B and D intersect at common axis E.

Figure 2:
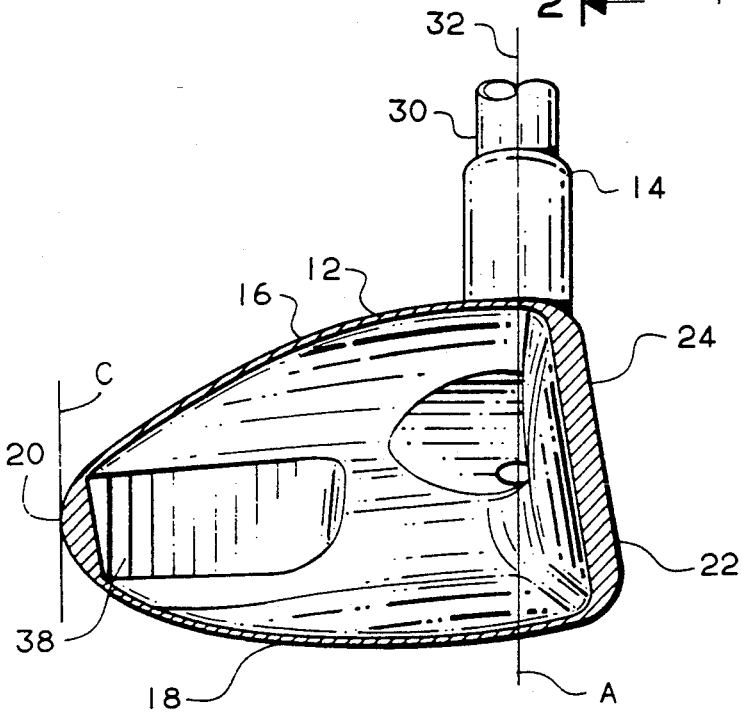
FIG. 2 is an enlarged sectional view taken along lines 2—2 in FIG. 1.
Figure 3:
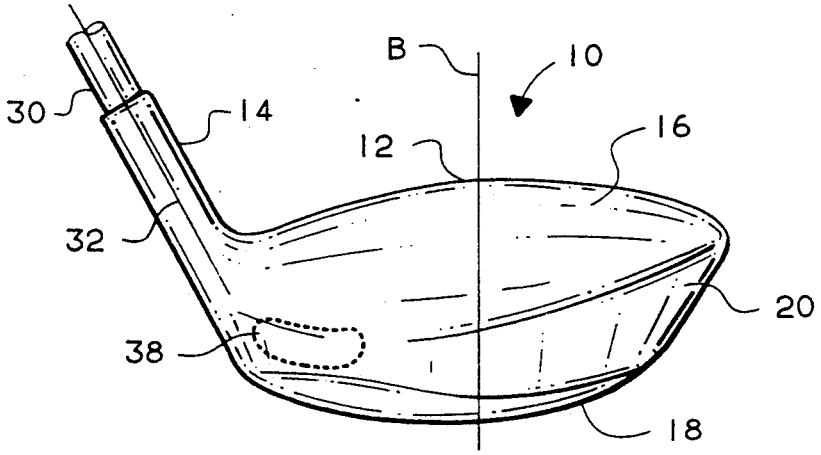
FIG. 3 is a rear elevational view of the golf club head shown in FIG. 1.

During testing of the club head 10, the weight pad 38 was located in three different locations inside the body 12 along the length dimension of the side wall 20. A first test location for the weight pad 38 was along the side wall 20 in the body toe portion 12*b*. This first test location created more fade type spin and more hook type spin on golf balls on off-center impacts by causing the club head face 24 to open and close farther. In other words, golf balls deviated farther from their intended path of travel when the weight pad 38 was located in the toe portion 12*b*. A second test location for the weight pad 38 was directly behind the sweet spot 26 and the center of gravity 28. This second test location had no effect on the fade type spin and the hook type spin on golf balls. That is, with the weight pad 38 located directly behind the center of gravity, golf balls travelled along the same path as when the weight pad 38 is eliminated from the club head 10. A third test location for the weight pad 38 was along the side wall 20 in the body heel portion 12*a*. This third test location created less fade spin and less hook spin on golf balls by resisting opening and closing of the face 24 on off-center impacts with golf balls. Therefore, golf balls travel closer to their intended path when the weight pad 38 is located as shown in FIGS. 1–3.

It will be understood that the top, bottom and side walls 16, 18 and 20 each have a thickness between 0.036 and 0.040 inch. The front wall 22 has a thickness between 0.128 and 0.135 inch.

What is claimed is:

1. A golf club head having a center of gravity, said golf club head comprising:

a hollow body having a heel portion, a toe portion, a top wall, a bottom wall, a side wall between said top and bottom walls, a front wall with a face for impacting a golf ball;

a hosel for receiving one end of an elongated shaft;

said face having a sweet spot thereon aligned with the center of gravity so that when a golf ball is impacted at said sweet spot no rotation of the club head will occur, said face being disposed forwardly of an inclined with respect to a first vertical plane containing a longitudinal axis of the elongated shaft, said face intersecting and being substantially perpendicular to a second vertical plane containing the center of gravity, said second vertical plane dividing said body into said heel and toe portions;

a weight pad disposed along said side wall in the heel portion of the body rearwardly of said first vertical plane and intermediate said hosel and said second vertical plane, said weight pad providing the golf club head with increased resistance to horizontal rotation about a vertical axis that extends through the center of gravity when the club head impacts a golf ball on the face at off-center points spaced laterally of the sweet spot;

said side wall having a length dimension measured between said first vertical plane and a third vertical plane which is disposed generally parallel to said first vertical plane while being located rearwardly of both said front wall and said hosel, said third vertical plane containing a rearwardmost point on said side wall, said weight pad being elongated in a direction extending along the length dimension of said side wall; and said weight pad being divided into two substantially equal parts by a fourth vertical plane which intersects the first and second vertical planes at approximately 45 degrees.

2. The golf club head of claim 1, wherein said weight pad weighs between 5 and 15 grams.

3. The golf club head of claim 1, wherein said hollow body is formed of metal.

4. The golf club head of claim 3, wherein said hollow body is formed of stainless steel.

5. The golf club head of claim 1, wherein said first, second and fourth vertical planes intersect at a common axis.

6. The golf club head of claim 1, wherein said top, bottom and side walls each have a thickness between 0.036 and 0.040 inch, and wherein said front wall has a thickness between 0.128 and 0.135 inch.

* * * * *